US012378724B2

(12) United States Patent
Sargent et al.

(10) Patent No.: US 12,378,724 B2
(45) Date of Patent: Aug. 5, 2025

(54) CELLULOSIC FLOORCOVERINGS AND APPLICATIONS THEREOF

(71) Applicant: Wilana Chemical LLC, Rome, GA (US)

(72) Inventors: Ralph R Sargent, Rome, GA (US); Dennis J. Jones, Jr., Signal Mountain, TN (US)

(73) Assignee: WILANA CHEMICAL LLC, Rome, GA (US)

( * ) Notice: Subject to any disclaimer, the term of this patent is extended or adjusted under 35 U.S.C. 154(b) by 753 days.

(21) Appl. No.: 15/602,820

(22) Filed: May 23, 2017

(65) Prior Publication Data

US 2017/0335511 A1 Nov. 23, 2017

Related U.S. Application Data

(60) Provisional application No. 62/340,345, filed on May 23, 2016.

(51) Int. Cl.
*D06N 3/14* (2006.01)
*D06N 3/00* (2006.01)

(52) U.S. Cl.
CPC ..... *D06N 3/14* (2013.01); *D06N 3/004* (2013.01); *D06N 2201/042* (2013.01); *D06N 2203/068* (2013.01); *D06N 2205/20* (2013.01); *D06N 2209/067* (2013.01); *D06N 2211/066* (2013.01)

(58) Field of Classification Search
CPC .... D06N 3/14; D06N 3/004; D06N 2201/042; D06N 2203/068; D06N 2205/20; D06N 2209/067; D06N 2211/066
USPC ..... 442/92
See application file for complete search history.

(56) References Cited

U.S. PATENT DOCUMENTS

| | | | | |
|---|---|---|---|---|
| 5,177,141 | A | 1/1993 | Thoma et al. | |
| 5,387,640 | A | 2/1995 | Michels et al. | |
| 2006/0074188 | A1* | 4/2006 | Franchina | D06M 15/27 524/833 |
| 2008/0160850 | A1* | 7/2008 | Kimbrell | D04B 1/14 442/94 |
| 2009/0258987 | A1* | 10/2009 | Ambrose | C09D 127/16 524/462 |
| 2010/0151184 | A1 | 6/2010 | Grigat et al. | |
| 2011/0127206 | A1 | 6/2011 | Meyer-Blumenroth et al. | |

FOREIGN PATENT DOCUMENTS

JP 1146964 A * 2/1999

OTHER PUBLICATIONS

International Search Report and Written Opinion corresponding to PCT/US2017/034013 mailed Aug. 3, 2017, 10 pages.
CRI "Flammability and Carpet Safety", Jun. 23, 2015, pp. 1-4.

* cited by examiner

*Primary Examiner* — Vincent Tatesure
(74) *Attorney, Agent, or Firm* — J. Clinton Wimbish; Maynard Nexsen PC

(57) ABSTRACT

In one aspect, cellulosic floor coverings having desirable flammability resistance are provided. Briefly, a floor covering described herein comprises cellulosic fibers or cellulose-based fibers and fluoropolymer adhered to surfaces of the cellulosic fibers or cellulose-based fibers in an amount sufficient for the floor covering to conform with or pass flammability testing with a methenamine-timed burning tablet according to Consumer Product Safety Commission (CPSC) Standard FF 2-70.

8 Claims, No Drawings

CELLULOSIC FLOORCOVERINGS AND APPLICATIONS THEREOF

CROSS REFERENCE TO RELATED APPLICATIONS

This application claims priority pursuant to 35 U.S.C. § 119(e) to U.S. Provisional Patent Application Ser. No. 62/340,345 filed on May 23, 2016, which is hereby incorporated by reference in its entirety.

FIELD

The present invention relates to floor coverings and, in particular, to flammability resistant floor coverings employing cellulosic fibers.

BACKGROUND

Manufactures of textiles are continuously searching for compositions to enhance textile fiber performance and durability. In the carpet and floor coverings industry, for example, manufacturers desire compositions operable to render carpet fibers stain resistant as well as flame resistant. Fluorinated carbon compounds have been used extensively to impart water and oil repellency to textile and carpet fibers. Fluorocarbon compounds can provide both oil and water repellency simultaneously, unlike waxes, silicones, etc., which typically provide water repellency, but are somewhat oleophilic, and thus do not provide good oil repellency.

Similarly, numerous flame retarding compounds have been developed for textiles, including carpets, to reduce or preclude the flammability of the fibers contained therein. Inorganic and organic tin compounds have been used to reduce the flammability of polyamides. Moreover, aluminum compounds have also found applicability as flammability retardants. These compounds, however, have not demonstrated completely satisfactory results under several testing conditions.

In addition to developing stain repellant and fire retardant chemical species, manufactures have additionally developed techniques for effectively applying these chemical species to textile fibers. Manufactures, for example, have developed complex solutions and techniques to exhaust fluoropolymer compositions onto textile fibers. In view of these complex exhaustion solutions and techniques, several fiber compositions, including cellulosic fibers, fail to exhibit acceptable flammability resistance. The inability to exhibit acceptable flammability resistance has severely restricted the use of cellulosic fibers, such as cotton, in residential and commercial carpeting applications.

SUMMARY

In one aspect, cellulosic floor coverings having desirable flammability resistance are provided. Briefly, a floor covering described herein comprises cellulosic fibers or cellulose-based fibers and fluoropolymer adhered to surfaces of the cellulosic fibers or cellulose-based fibers in an amount sufficient for the floor covering to conform with or pass flammability testing with a methenamine-timed burning tablet according to Consumer Product Safety Commission (CPSC) Standard FF 2-70. In some embodiments, fluorine is present on the cellulosic fibers or cellulose-based fibers in an amount of 500 parts per million (ppm) to 2500 ppm.

In another aspect, methods of making floor coverings are described herein. A method of making a floor covering, in some embodiments, comprises coupling cellulosic fibers or cellulose-based fibers to a backing and treating the cellulosic fibers or cellulose-based fibers with a composition comprising fluoropolymer in an amount sufficient for the floor covering to conform with or pass flammability testing with a methenamine-timed burning tablet according to CPSC Standard FF 2-70.

These and other embodiments are described in greater detail in the detailed description.

DETAILED DESCRIPTION

Embodiments described herein can be understood more readily by reference to the following detailed description, examples, and drawings. Elements, apparatus, and methods described herein, however, are not limited to the specific embodiments presented in the detailed description, examples, and drawings. It should be recognized that these embodiments are merely illustrative of the principles of the present invention. Numerous modifications and adaptations will be readily apparent to those of skill in the art without departing from the spirit and scope of the invention.

In addition, all ranges disclosed herein are to be understood to encompass any and all subranges subsumed therein. For example, a stated range of "1.0 to 10.0" should be considered to include any and all subranges beginning with a minimum value of 1.0 or more and ending with a maximum value of 10.0 or less, e.g., 1.0 to 5.3, or 4.7 to 10.0, or 3.6 to 7.9.

The term "optionally substituted" means that the group in question is either unsubstituted or substituted with one or more of the substituents specified. When the groups in question are substituted with more than one substituent, the substituent may be the same or different.

The term "alkyl" as used herein, alone or in combination, refers to a straight or branched chain saturated monovalent hydrocarbon radical. In some embodiments, for example, alkyl groups include, but are not limited to, methyl, ethyl, n-propyl, isopropyl, n-butyl, sec-butyl, isobutyl, tert-butyl, n-pentyl, 2-methylbutyl, 3-methylbutyl, 4-methylpentyl, neopentyl, n-pentyl, n-hexyl, n-heptyl, n-octyl, 1,2-dimethylpropyl, 2,2-dimethylpropyl, 1,2,2-trimethylpropyl and the like. In some embodiments an alkyl group contains one to thirty carbon atoms.

The term "aryl" as used herein refers to a carbocyclic aromatic ring radical or to an aromatic ring system radical. Aryl is also intended to include the partially hydrogenated derivatives of the carbocyclic systems.

I. Floor Coverings

In one aspect, cellulosic floor coverings having desirable flammability resistance are provided. For example, a floor covering described herein comprises cellulosic fibers or cellulose-based fibers and fluoropolymer adhered to surfaces of the cellulosic fibers or cellulose-based fibers in an amount sufficient for the floor covering to conform to flammability testing with a methenamine-timed burning tablet according to CPSC Standard FF 2-70. In some embodiments, fluorine content on the cellulosic fibers or cellulose-based fibers is 500 ppm to 2500 ppm. Fluorine can also be present on the cellulosic fibers or cellulose-based fibers in an amount selected from Table I.

TABLE I

| Cellulosic Fiber Fluorine Content (ppm) |
|---|
| 500-2000 |
| 700-1800 |
| 900-1700 |
| 1000-1500 |

Fluoropolymers suitable for use in compositions described herein can comprise perfluorinated polyurethanes, perfluorinated polyacrylate copolymers, perfluorinated urethane-acrylic copolymers, fluoroalkyl methacrylates, fluoroalkyl acrylates, fluoroalkyl aryl urethanes, aliphatic fluoroalkyl urethanes, fluoroalkyl allyl urethanes, fluoroalkyl urethane acrylates, fluoroalkyl acrylamides, fluoroalkyl sulfonamide acrylates, fluoroalkyl sulfonamide methacrylates, fluoroalkyl sulfonamide urethanes, fluoroalkylesters, fluoroesters or fluoroethers or mixtures thereof. Suitable fluoropolymers, in some embodiments, also comprise polytetrafluoroethylene (PTFE), fluorinated ethylene-propylene (FEP), perfluoroalkoxy resin (PFA), polychlorotrifluoroethylene (PCTFE), ethylene-tetrafluoroethylene (EPTFE), polyvinylidene fluoride (PVDF) or polyvinyl fluoride (PVF) or mixtures thereof. In some embodiments, the fluoropolymers are crosslinked through cross-linking moieties.

In some embodiments, fluoropolymer is formula (I):

$$R_f—R^1—P \quad (I)$$

wherein P is a polymerizable moiety, $R_f$ is a straight chain or branched perfluoroalkyl group and $R^1$ is selected from the group consisting of alkyl, aryl, -alkyl-aryl-, -aryl-alkyl- and -alkyl-O-alkyl-. $R_f$, in some embodiments, is $<C_8$, such as $C_4$ to $C_6$. Alternatively, $R_f$ can be $C_4$ to $C_{20}$.

P, in some embodiments, comprises a site of unsaturation operable to undergo radical polymerization. In one embodiment, for example, P comprises a vinyl functionality, allyl functionality, acrylic functionality or methacrylic functionality. In other embodiments, P comprises a functionality operable to undergo condensation polymerization, such as an isocyanate or hydroxyl functionality. In some embodiments, fluoropolymer includes one or more $C_6$-perfluorourethanes.

Fluoropolymers suitable for use on cellulosic fibers or cellulose-based fibers described herein, in some embodiments, are commercially available from Peach State Labs of Rome, Georgia under the Sartech trade designation including, but not limited to, Sartech GEO 8168, Sartech GEO 600 and/or Sartech GEO 83. Suitable fluoropolymers are also commercially available from Daikin Industries, Inc. or Osaka Japan under the UNIDYNE® trade designation including, but not limited to, TG7114, TG2113, TG2112, TG581, TG7411 and TG2213. In some embodiments, suitable fluoropolymers are commercially available form DuPont of Wilmington, Delaware under the ZONYL® and OLEOPHOBOL® trade designations. Further, suitable fluoropolymers are commercially available from Clariant, Inc. of Charlotte, NC under the NUVA® trade designation or from Asahi Glass of Tokyo, Japan under the ASAHI-GUARD® E-Series trade designation.

Fluoropolymer, in some embodiments, is cross-linked with the cellulosic fibers or cellulose-based fibers via a crosslinking component. Suitable cross-linking components can be selected according to several considerations including, but not limited to, chemical functionalities of the fluoropolymer and surface functionalities of the cellulosic fibers. In some embodiments, one or more polyisocyanates are employed in the cross-linking component. For example, polyisocyanate cross-linking species can cross-link polyfluorourethanes with the cellulosic fibers and/or cellulose-based fibers in some embodiments. As described further herein, polyisocyanate(s) can be provided in blocked form and subsequently heated for de-blocking and cross-linking fluoropolymer with the cellulosic fibers or cellulose-based fibers. Cross-linking fluoropolymer to the cellulosic fibers or cellulose-based fibers can enhance durability and adhesion of the fluoropolymer treatment.

Examples of polyisocyanates for preparing the blocked polyisocyanates of the cross-linking component include aromatic as well as aliphatic polyisocyanates. Suitable polyisocyanates for the preparation of blocked polyisocyanates can be di- or triisocyanates as well as mixtures thereof. Specific examples are aromatic diisocyanates such as 4,4'-methylenediphenylenediisocyanate, 4,6-di-(trifluoromethyl)-1,3-benzene diisocyanate, 2,4-toluenediisocyanate, 2,6-toluene diisocyanate, o, m, and p-xylylene diisocyanate, 4,4'-diisocyanatodiphenylether, 3,3'-dichloro-4,4'-diisocyanatodiphenylmethane, 4,5'-diphenyldiisocyanate, 4,4'-diisocyanatodibenzyl, 3,3'-dimethoxy-4,4'-diisocyanatodiphenyl, 3,3'-dimethyl-4,4'-diisocyanatodiphenyl, 2,2'-dichloro-5,5'-dimethoxy-4,4'-diisocyanato diphenyl, 1,3-diisocyanatobenzene, 1,2-naphthylene diisocyanate, 4-chloro-1,2-naphthylene diisocyanate, 1,3-naphthylene diisocyanate, and 1,8-dinitro-2,7-naphthylene diisocyanate and aromatic triisocyanates such as polymethylenepolyphenylisocyanate.

Additional isocyanates that can be used for preparing a blocked isocyanate include alicyclic diisocyanates such as 3-isocyanatomethyl-3,5,5-trimethylcyclohexylisocyanate; aliphatic diisocyanates such as 1,6-hexamethylenediisocyanate; aromatic tri-isocyanates, such as polymethylenepolyphenylisocyanate (PAPI); cyclic diisocyanates such as isophorone diisocyanate (IPDI) and dicyclohexylmethane-4,4'-diisocyanate. Also useful are isocyanurate-containing triisocyanates such as that available from Huls AG, Germany, as IPDI-1890 and azetedinedione-containing diisocyanates such as that available from Bayer as DESMODUR® TT. Also, other di- or tri-isocyanates such as those available from Bayer as DESMODUR® L and DESMODUR® W, and tri-(4-isocyanatophenyl)-methane (available from Bayer as DESMODUR®R) and DDI 1410 from Henkel are suitable. Commercially available blocked aromatic polyisocyanates include BAYGARD® EDW available from Bayer Corp. and HYDROPHOBOL® XAN available from Huntsman Corporation of Salt Lake City, Utah, formerly from Ciba Specialty Chemicals.

Various examples of aliphatic polyisocyanates include, but are not limited to, those selected from the group consisting of 1,4-tetramethylene diisocyanate, hexamethylene 1,4-diisocyanate, hexamethylene, 1,6-diisocyanate (HDI), 1,12-dodecane diisocyanate, 2,2,4-trimethyl-hexamethylene diisocyanate (TMDI), 2,4,4-trimethyl-hexamethylene diisocyanate (TMDI), 2-methyl-1,5-pentamethylene diisocyanate, dimer diisocyanate, the urea of hexamethylene diisocyanate, the biuret of hexamethylene 1,6-diisocyanate (HDI) (available as DESMODUR® N-100 and N-3200 from Bayer Corporation), the isocyanurate of HDI (available as DESMODUR(TM) N-3300 and DESMODUR® N-3600 from Bayer Corporation), a blend of the isocyanurate of HDI and the uretdione of HDI (available as DESMODUR® N3400 available from Bayer Corporation), and mixtures thereof.

Isocyanate blocking agents are compounds that, upon reaction with an isocyanate group, yield a group that is unreactive at room temperature with compounds that normally react with an isocyanate at room temperature. Generally, at elevated temperatures the blocking group will be released from the blocked polyisocyanate group thereby generating the isocyanate group again which can then react with an isocyanate reactive group, such as may be found on the surface of a fibrous substrate. In some embodiments, blocking agents include arylalcohols such as phenols, lactams such as ϵ-caprolactam, δ-valerolactam, γ-butyrolactam, oximes such as formaldoxime, acetaldoxime, methyl ethyl ketone oxime, cyclohexanone oxime, acetophenone oxime, benzophenone oxime, 2-butanone oxime or diethyl glyoxime. Further suitable blocking agents include bisulfite and triazoles. One or more blocking agents may be used.

In some embodiments, isocyanate species form allophanate cross-links, biuret cross-links or combinations thereof between the fluoropolymer and cellulosic fibers or cellulose-based fibers.

Cellulosic or cellulose-based fibers of the floor covering, in some embodiments, are cotton. Fibers of the floor covering face, for example, can be solely cellulosic fibers or cellulose-based fibers. Alternatively, fibers of the floor covering face can be a blend of cellulosic fibers or cellulose-based fibers and one more other types of natural and/or synthetic fibers. Other natural fibers can include, but are not limited to, wool, flax, jute, hemp and/or silk. Moreover, synthetic fibers can include olefinic fibers, polyamide fibers, polyethylene terephthalate (PET) fibers and/or polytrimethylene terephthalate (PTT) fibers. Floor coverings described herein can be carpets or rugs. In some carpet/rug embodiments, the cellulosic fibers or cellulose-based fibers form a tufted pile. In other carpet/rug embodiments, the cellulosic fibers or cellulose-based fibers for a loop pile.

As described herein, floor coverings comprising cellulosic fibers or cellulose-based fibers having fluoropolymer applied thereto pass flammability testing according to CPSC Standard FF 2-70. The procedure under CPSC Standard FF 2-70 is summarized as follows. The test consists of exposing eight 9 inch×9 inch samples to a timed burning tablet in a specified test chamber. The apparatus and test materials required to conduct the test are specified in 16 C.F.R. §§ 1630.4(a) and 1631.4(a). Each specimen is placed in the center of the floor of the test chamber, traffic side up. A flattening frame is placed on the sample and methenamine-timed burning tablet is positioned on one of its flat sides in the center of the 8 inch flattening frame hole. The table is ignited with a flame source and the test is continued until (1) all flames and glowing disappear or (2) the flaming or smoldering has gone to within 1 inch of the flattening frame. A single specimen passes the test if the charred portion of the tested specimen is not within 1.0 inch of the edge of the hole in the flattening frame. At least 7 of the 8 replicate samples of a given carpet or rug construction must individually pass in order for the carpet or rug construction to conform to the standard.

Notably, floor coverings described herein conform with CPSC Standard FF 2-70 without requiring additional flame retarding species in the floor coverings and/or on the cellulosic fibers or cellulose-based fibers. Fluropolymer is present on the cellulosic fibers and/or cellulose-based fibers in amounts sufficient to enable conformity with CPSC Standard FF 2-70.

II. Methods of Making Floor Coverings

In another aspect, methods of making floor coverings are described herein. A method of making a floor covering, in some embodiments, comprises coupling cellulosic fibers or cellulose-based fibers to a backing and treating the cellulosic fibers or cellulose-based fibers with a composition comprising fluoropolymer in an amount sufficient for the floor covering to conform with or pass flammability testing with a methenamine-timed burning tablet according to CPSC Standard FF 2-70.

The fluoropolymer, in some embodiments, is provided as an aqueous dispersion or emulsion comprising fluoropolymer particles. The fluoropolymer particles can have an average size ranging from about 30 nm to about 200 nm. In some embodiments, fluoropolymer particles have an average size ranging from about 40 nm to about 100 nm or from about 50 nm to about 70 nm. Suitable fluoropolymers for the aqueous dispersion or emulsion are provided in Section I hereinabove. As described herein, fluoropolymer is present in the treatment composition in an amount sufficient for the floor covering to conform with CPSC Standard FF 2-70. For example, fluoropolymer can be present in the composition at an add-on level of 0.1% on weight fiber (owf) to 3% owf. In some embodiments, fluoropolymer is present in the treatment composition at add-on levels according to Table II.

TABLE II

| Amount Fluoropolymer (owf) |
|---|
| 0.5-2.5 |
| 0.7-2.0 |
| 0.9-1.5 |
| 1.0-2.0 |

Such add-on levels can provide the cellulosic fibers or cellulose-based fibers a fluorine content of 500 ppm to 2500 ppm. In some embodiments, fluorine is present on the cellulosic fibers or cellulose-based fibers in an amount selected from Table I herein.

The treatment composition can also comprise a cross-linking component. Suitable cross-linking components can be selected according to several considerations including, but not limited to, chemical functionalities of the fluoropolymer and surface functionalities of the cellulosic fibers or cellulose-based fibers. In some embodiments, one or more polyisocyanates are employed in the cross-linking component. Suitable polyisocyanates are described in Section I herein and can be in blocked form to preclude premature reactivity. The treated floor covering composition can be subsequently heated to unblock the polyisocyanates and crosslink fluoropolymer to the cellulosic fibers or cellulose-based fibers. Heating temperatures and time are generally dependent on the specific blocked isocyanate(s) of the treatment composition.

The cross-linking component can be present in the treatment composition in any amount not inconsistent with the objectives of the present invention. In some embodiments, the cross-linking component is present in an amount of 0.25% owf to 2.0% owf. In other embodiments, the cross-linking component is present in an amount of 0.5% owf to 1.5% owf.

The treatment composition can be applied to the floor covering through a variety of systems, including a padding system. In such embodiments, the fluoropolymer and optional cross-linking component can be applied in single step. Alternatively, fluoropolymer and cross-linking component can be applied by a padding system in separate steps. The treatment composition comprising fluoropolymer and optional cross-linking component can also be applied by a foaming system with the aid of a foaming agent. In further embodiments, the treatment composition can be employed with an exhaust system with one or more suitable exhaustion agents.

As described in Section I herein, cellulosic or cellulose-based fibers of the floor covering, in some embodiments, are cotton. Fibers of the floor covering face, for example, can be solely cellulosic fibers or cellulose-based fibers. Alternatively, fibers of the floor covering face can be a blend of cellulosic fibers or cellulose-based fibers and one more other types of natural and/or synthetic fibers. Floor coverings described herein can be carpets or rugs. In some carpet/rug embodiments, the cellulosic fibers or cellulose-based fibers form a tufted pile. In other carpet/rug embodiments, the cellulosic fiber or cellulose-based fibers for a loop pile.

These and other embodiments are further illustrated by the following non-limiting example.

EXAMPLE 1

Cotton Floor Covering

Griege cotton fabric in the form of a bath rug was provided. The bath rug was 21 inches wide by 40 inches long, and the pile consisted of 100% cotton in a loop pile/cut pile, patterned construction. The color was Grey Shadow. A treatment composition consisting of an aqueous dispersion of $C_6$-perfluorourethane (GEO 8168, 4%) at 32.5 g/l and HYDRPHOBOL® XAN cross-linker at 10.4 g/l was provided. The aqueous dispersion was applied using a padder, operating at pressures that resulted in 58% wet pick up (wpu) of the treatment composition being deposited on to the cotton griege fabric. After application of the treatment composition, the treated cotton griege fabric was exposed to drying 275° F. for 15 minutes. The treated cotton rug was tested for ppm fluorine content, and 1245 ppm fluorine was found to reside on the cotton fibers.

The treated cotton rug was subsequently tested in accordance with CPSC FF2-70. Each of the eight test samples passed and conformed to CPSC FF2-70. An untreated cotton rug of identical composition was tested under CPSC FF2-70 for comparative purposes. All eight samples of the untreated cotton rug failed.

Various embodiments of the invention have been described in fulfillment of the various objects of the invention. It should be recognized that these embodiments are merely illustrative of the principles of the present invention. Numerous modifications and adaptations thereof will be readily apparent to those skilled in the art without departing from the spirit and scope of the invention.

The invention claimed is:

1. A floor covering comprising:

cellulosic fibers or cellulose-based fibers; and fluoropolymer adhered to surfaces of the cellulosic fibers or cellulose-based fibers, the fluoropolymer cross-linked to the cellulosic fibers or cellulose-based fibers via a cross-linking component, in an amount sufficient for the floor covering to pass flammability testing with a methenamine-timed burning tablet according to Consumer Product Safety Commission (CPSC) Standard FF 2-70, wherein fluorine content on the cellulosic fibers or cellulose-based fibers, based on the fluoropolymer adhered to the surfaces, is 500 parts per million (ppm) to 2500 ppm, wherein the fluoropolymer is selected from the group consisting of perfluorinated urethanes, aliphatic fluoroalkyl urethanes, fluoroalkyl-urethane acrylates, fluoroalkyl allyl urethanes and perfluorinated urethane-acrylic copolymers, and wherein the cross-linking component is one or more of: 4,6-di-(trifluoromethyl)-1,3-benzene diisocyanate, 4,4'-diisocyanatodiphenylether, 3,3'-dichloro-4,4'-diisocyanatodiphenylmethane, 4,5'-diphenyldiisocyanate, 4,4'-diisocyanatodibenzyl, 3,3'-dimethoxy-4,4'-diisocyanatodiphenyl, 2,2'-dichloro-5,5'-dimethoxy-4,4'-diisocyanato diphenyl, 1,3-diisocyanatobenzene, 4-chloro-1,2-naphthylene diisocyanate, and 1,8-dinitro-2,7-naphthylene diisocyanate.

2. The floor covering of claim 1, wherein the fluorine content on the cellulosic fibers or cellulose-based fibers is 800 ppm to 1600 ppm.

3. The floor covering of claim 1, wherein the fluoropolymer is a $C_6$-perfluorourethane.

4. The floor covering of claim 1, wherein the cross-linking component forms allophanate cross-links, biuret cross-links or combinations thereof.

5. The floor covering of claim 1, wherein the cellulosic fibers are cotton.

6. The floor covering of claim 1, wherein the floor covering is carpet.

7. The floor covering of claim 6, wherein the cellulosic fibers or cellulose-based fibers form a tufted pile.

8. The floor covering of claim 6, wherein the cellulosic fibers or cellulose-based fibers form a loop pile.

* * * * *